US007894757B2

(12) United States Patent
Matsuno

(10) Patent No.: US 7,894,757 B2
(45) Date of Patent: Feb. 22, 2011

(54) IMAGE FORMING DEVICE HAVING BIASING MEMBER FOR REGULATING SHEETS AND IMAGE FORMING METHOD THE SAME

(75) Inventor: Akinori Matsuno, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 12/541,666

(22) Filed: Aug. 14, 2009

(65) Prior Publication Data

US 2010/0104331 A1 Apr. 29, 2010

(30) Foreign Application Priority Data

Oct. 29, 2008 (JP) ..... 2008-278008

(51) Int. Cl.
*G03G 15/00* (2006.01)
*G03G 15/16* (2006.01)

(52) U.S. Cl. ..... 399/316; 399/388

(58) Field of Classification Search ..... 399/316, 399/317, 388, 390
See application file for complete search history.

(56) References Cited

U.S. PATENT DOCUMENTS 6,055,409 A * 4/2000 Richards et al. ..... 399/388
2008/0292371 A1* 11/2008 Murayama ..... 399/316

FOREIGN PATENT DOCUMENTS

| | | | |
|---|---|---|---|
| JP | 57-088474 A | * | 6/1982 |
| JP | 59-005252 A | * | 1/1984 |
| JP | 05-046033 A | * | 2/1993 |
| JP | 07-160129 A | * | 6/1995 |
| JP | 10-232567 | | 9/1998 |
| JP | 11-305511 A | * | 11/1999 |
| JP | 2002-139930 A | * | 5/2002 |

* cited by examiner

*Primary Examiner*—Sophia S Chen
(74) *Attorney, Agent, or Firm*—K&L Gates LLP

(57) ABSTRACT

An image forming device includes: a transfer roller; two registration rollers feeding a recording medium to a transfer nip where the transfer roller is in contact with an image bearing member; a transfer conveying-path through which the recording medium is fed from a registration nip formed by the registration rollers to the transfer nip; a lower guide defining a lower side of the transfer conveying-path and having an uppermost portion protruding upwardly at a position upstream of the transfer nip; and a biasing member provided at an upper side of the transfer conveying-path and between the uppermost portion and the registration rollers, and biasing the recording medium downwardly when it is fed through the registration rollers. The biasing member is movable upwardly relative to a pressing force of the recording medium that is fed through the transfer conveying-path.

13 Claims, 14 Drawing Sheets

IMAGE FORMING DEVICE HAVING BIASING MEMBER FOR REGULATING SHEETS AND IMAGE FORMING METHOD THE SAME

INCORPORATION BY REFERENCE

This application is based upon and claims the benefit of priority from the corresponding Japanese Patent application No. 2008-278008, filed Oct. 29, 2008, the entire content of which is incorporated herein by reference.

BACKGROUND

1. Field of the Invention

The present invention relates to image forming devices for forming developer images on transfer media and to image forming devices having an image forming section and a transfer conveying-section.

2. Description of the Related Art

In image forming devices, such as copiers, printers, and facsimile devices, a sheet stored in a sheet cassette is fed to a transfer nip where a toner image is transferred onto the sheet. Subsequently, the sheet is fed to a fixing unit where the transferred toner image is fixed to the sheet. Then, the sheet having the toner image formed thereon is ejected from the device.

When the transfer process is to be performed, a pair of registration rollers provided upstream from the transfer nip stops the sheet, which is fed slantwise from the sheet cassette, and positions the sheet to the proper orientation. The stopped sheet is outputted from a nip formed by the pair of registration rollers in accordance with the timing of the transfer process.

If a large-size paper having low elasticity is used as the sheet on which a toner image is to be formed, the sheet may tend to undulate during the feeding operation, consequently leading to a transfer defect. In light of this, a configuration as shown in FIG. 14 is used.

FIG. 14 illustrates an example of the configuration of a section between a pair of registration rollers and a transfer nip in an image forming device. As shown in FIG. 14, a transfer nip 1003 is formed between a photosensitive drum 1001 and a transfer roller 1002. A registration nip 1006 is formed between registration rollers 1004 and 1005 at a position upstream of the transfer nip 1003. A conveying path 1009, used for feeding a sheet 1000 from the registration nip 1006 to the transfer nip 1003, is formed by an upper guide 1007 and a lower guide 1008. The lower guide 1008 has an uppermost portion 1008*a* at an uppermost position and slopes therefrom towards the registration nip 1006 and the transfer nip 1003. The uppermost portion 1008*a* is positioned higher than the registration nip 1006 and the transfer nip 1003.

With this configuration, the sheet 1000 can be curved during the feeding operation so that even if the sheet is large and thin, which means that the sheet has low elasticity and tends to undulate easily, the undulation thereof can be reduced, thereby allowing for a satisfactory transfer process.

However, when a normal sheet or a thick sheet is fed through the image forming device shown in FIG. 14, the elasticity of the sheet may cause the trailing end thereof to spring upwardly as the trailing end comes off the registration nip 1006. This may cause the trailing end to strike the upper guide 1007, resulting in the occurrence of transfer deviation.

As an attempt for preventing such transfer deviation, an image forming device equipped with a trailing-end-springing prevention member near the exit of the registration nip 1006 has been used.

In an image forming device shown in FIG. 15, the upper guide 1007 is provided with a trailing-end-springing prevention member 1010 at a position near the exit of the registration nip 1006. This trailing-end-springing prevention member 1010 prevents the trailing end of a sheet from springing upwardly so as to minimize the occurrence of transfer deviation.

To further minimize the occurrence of transfer deviation in this configuration, it is necessary to reduce the amount by which the trailing end springs upward. In order to achieve this, it is preferable that the trailing-end-springing prevention member 1010 is located where it comes into contact with a sheet at a vertical position as close to that of the registration nip 1006 as possible.

However, if the trailing-end-springing prevention member 1010 is located where it comes into contact with a sheet at a vertical position close to that of the registration nip 1006, when a sheet having high elasticity, such as a thick sheet, is used, the friction between the sheet and the trailing-end-springing prevention member 1010 may lower the feed rate of the sheet. This is problematic in that a resultant transferred image may be compressed into a region that is shorter than the proper feeding distance (referred to as "image shrinkage" hereinafter).

SUMMARY

An advantage of the present invention to provide an image forming device that can minimize the occurrence of transfer deviation and image shrinkage.

To this end, the present invention provides an image forming device having an image forming section and a transfer conveying-section, comprising: a transfer roller; a pair of registration rollers that feed the recording medium to a transfer nip where the transfer roller is in contact with an image bearing member; a transfer conveying-path through which the recording medium is fed from a registration nip formed by the pair of registration rollers to the transfer nip; a lower guide defining a lower side of the transfer conveying-path and having an uppermost portion that protrudes upwardly at a position upstream of the transfer nip; and a biasing member provided at an upper side of the transfer conveying-path and between the uppermost portion and the pair of registration rollers, and configured to bias the recording medium downwardly when the recording medium is fed through the pair of registration rollers, and the biasing member is movable upward relative to the transfer conveying-path in accordance with a pressing force applied by the recording medium fed through the transfer conveying-path.

Additional features and advantages are described herein, and will be apparent from the following Detailed Description and the figures.

BRIEF DESCRIPTION OF THE FIGURES

In the accompanying drawings:

FIG. 5(*b*) is a perspective view illustrating a state where the trailing-end-springing prevention member is added to the components constituting the developing unit in the embodiment of FIG. 2;

FIG. 6(*b*) is another partial cross-sectional view illustrating the thick sheet being fed through the transfer conveying-path in the printer according to the embodiment of FIG. 2;

FIG. 6(*c*) is another partial cross-sectional view illustrating the thick sheet being fed through the transfer conveying-path in the printer according to the embodiment of FIG. 2;

FIG. 6(*d*) is another partial cross-sectional view illustrating the thick sheet being fed through the transfer conveying-path in the printer according to the embodiment of FIG. 2;

FIG. 6(*e*) is another partial cross-sectional view illustrating the thick sheet being fed through the transfer conveying-path in the printer according to the embodiment of FIG. 2;

FIG. 13(*b*) is another partial cross-sectional view illustrating the thick sheet being fed through the transfer conveying-path in the printer according to the embodiment of FIG. 11;

FIG. 13(*c*) is another partial cross-sectional view illustrating the thick sheet being fed through the transfer conveying-path in the printer according to the embodiment of FIG. 11;

DETAILED DESCRIPTION

Embodiments of the present invention will be described below with reference to the attached drawings.

Figure 1:
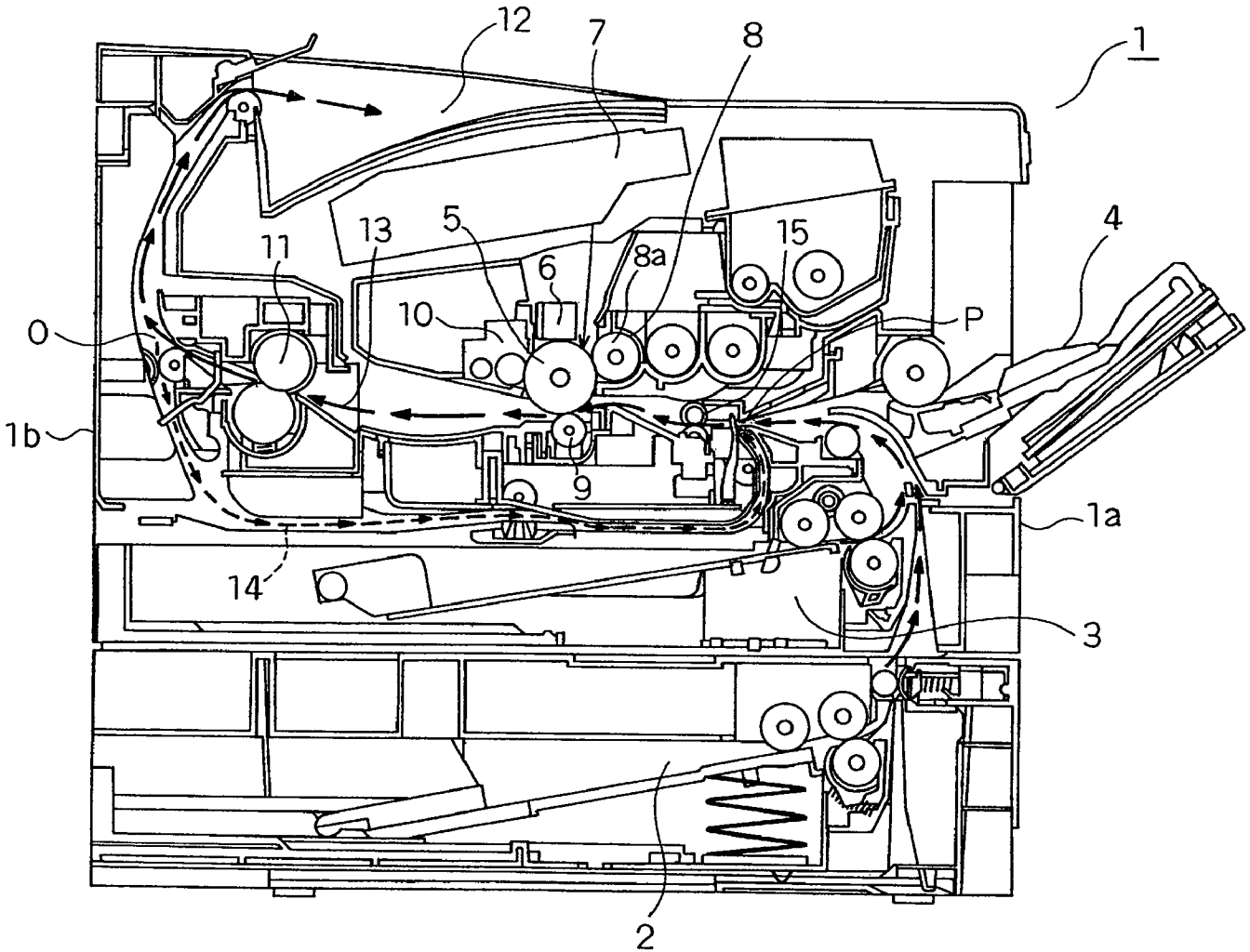
FIG. 1 is a cross-sectional view showing an entire printer according to an embodiment of the present invention, as viewed from one side thereof.

FIG. 1 is a cross-sectional view of a printer 1 according to an embodiment of the present invention.

The printer 1 according to the embodiment shown in FIG. 1 is a monochrome printer. The printer 1 includes a sheet cassette 2 that is located at a lower section of the device body of the printer 1 and stores sheets on which toner images are to be formed and another sheet cassette 3 located above the sheet cassette 2. A front surface 1*a* of the printer 1 is provided with a manual feed tray 4.

A photosensitive drum 5, which is an example of an image bearing member pursuant to the present invention, is located above the sheet cassette 3 and is surrounded by a charging unit 6 that uniformly electrically charges the surface of the photosensitive drum 5, an exposure unit 7 that forms an electrostatic latent image by exposing the charged surface to light, a developing unit 8 that forms a toner image by developing the electrostatic latent image, a transfer roller 9 that transfers the toner image to a sheet P, and a cleaning unit 10 that removes toner remaining on the surface after the transfer process. The charging unit 6, the exposure unit 7, the developing unit 8, the transfer roller 9, and the cleaning unit 10 are located in that order in a clockwise direction around the photosensitive drum 5. The developing unit 8 is positioned such that a developing roller 8*a* thereof faces the photosensitive drum 5.

The printer 1 has a conveying path 13 (indicated by solid arrows) formed therein. The conveying path 13 initially extends upwardly along the front surface 1*a* from the sheet cassettes 2 and 3, then changes direction so as to extend through between the transfer roller 9 and the photosensitive drum 5, then extends through a fixing unit 11, which is provided for fixing the transferred toner image onto the sheet P, and then extends toward a rear surface 1*b* of the printer 1. Finally, the conveying path 13 extends upwardly along the rear surface 1*b* so that the sheet P having the fixed toner image thereon can be discharged to an output tray 12.

In the feeding direction of the sheet P, a pair of registration rollers 15 are located upstream of the transfer roller 9. Specifically, the pair of registration rollers 15 are configured to temporarily stop the sheet P to correct the orientation of the sheet P and output the sheet P in accordance with the timing of the transfer process.

The printer 1 is also provided with a duplex-printing conveying-path 14. The duplex-printing conveying-path 14 branches off from the conveying path 13 at a location (see location O) downstream of the fixing unit 11, extends below the conveying path 13, and merges with the conveying path 13 at a location (see location P) upstream of the pair of registration rollers 15. The duplex-printing conveying-path 14 is indicated by dashed arrows in FIG. 1. The duplex-printing conveying-path 14 is used for guiding the sheet P back to the transfer roller 9 when performing duplex printing on the sheet P.

Figure 2:
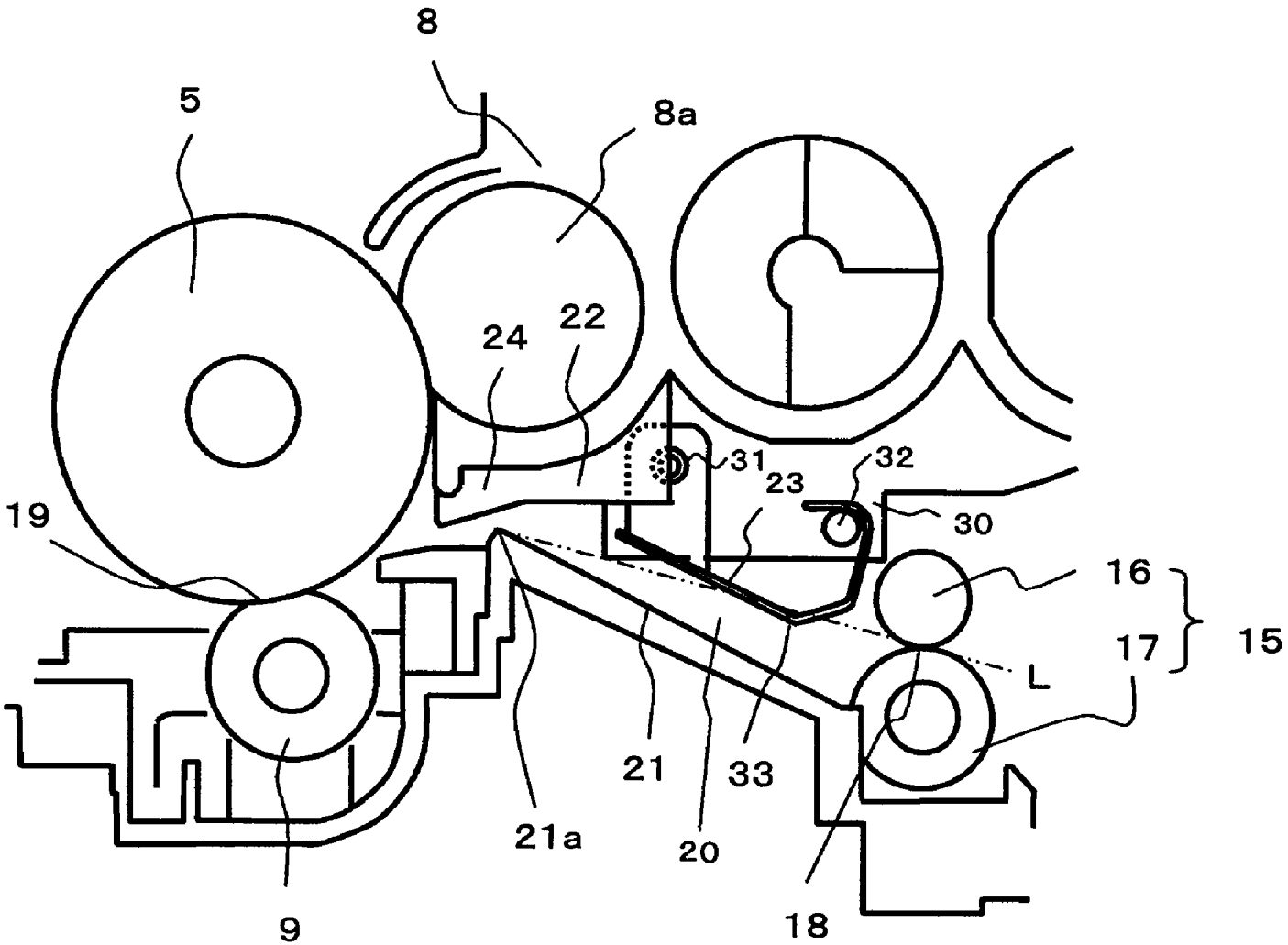
FIG. 2 is a partial cross-sectional view of a section between a registration nip and a transfer nip in the printer according to an embodiment.

FIG. 2 is an enlarged view of a section between the pair of registration rollers 15 and the transfer roller 9. The pair of registration rollers 15 is defined by two registration rollers 16 and 17 that form a registration nip 18 therebetween. Furthermore, the photosensitive drum 5 and the transfer roller 9 form a transfer nip 19 therebetween. A section of the conveying path 13 extending between the registration nip 18 and the transfer nip 19 will be referred to as a transfer conveying-path 20. In the transfer conveying-path 20, the sheet P is fed in substantially a horizontal direction. The lower side of the transfer conveying-path 20 is defined by a lower guide 21, whereas the upper side thereof is defined by an upper guide 22.

The lower guide 21 is sloped such that it gradually increases its height from the registration nip 18 towards the transfer nip 19. This increasing slope terminates at the upstream side of the transfer nip 19, such that an upwardly protruding end of the slope acts as an uppermost portion 21*a* of the lower guide 21.

In this case, the uppermost portion 21*a* is positioned higher than the transfer nip 19 and the registration nip 18. The height of the uppermost portion 21*a*, the transfer nip 19, and the registration nip 18 decreases in that order. At the downstream side of the uppermost portion 21*a* of the lower guide 21, a slope and a step extend toward the transfer nip 19 located below the uppermost portion 21*a*.

In this embodiment, the upper guide 22 is defined by the lower surface of the developing unit 8. The transfer conveying-path 20, defined by the lower guide 21 and the upper guide 22, is provided with a trailing-end-springing prevention member (biasing member) 23 that prevents the trailing end of the sheet P fed from the registration nip 18 from springing upward.

Figure 3:
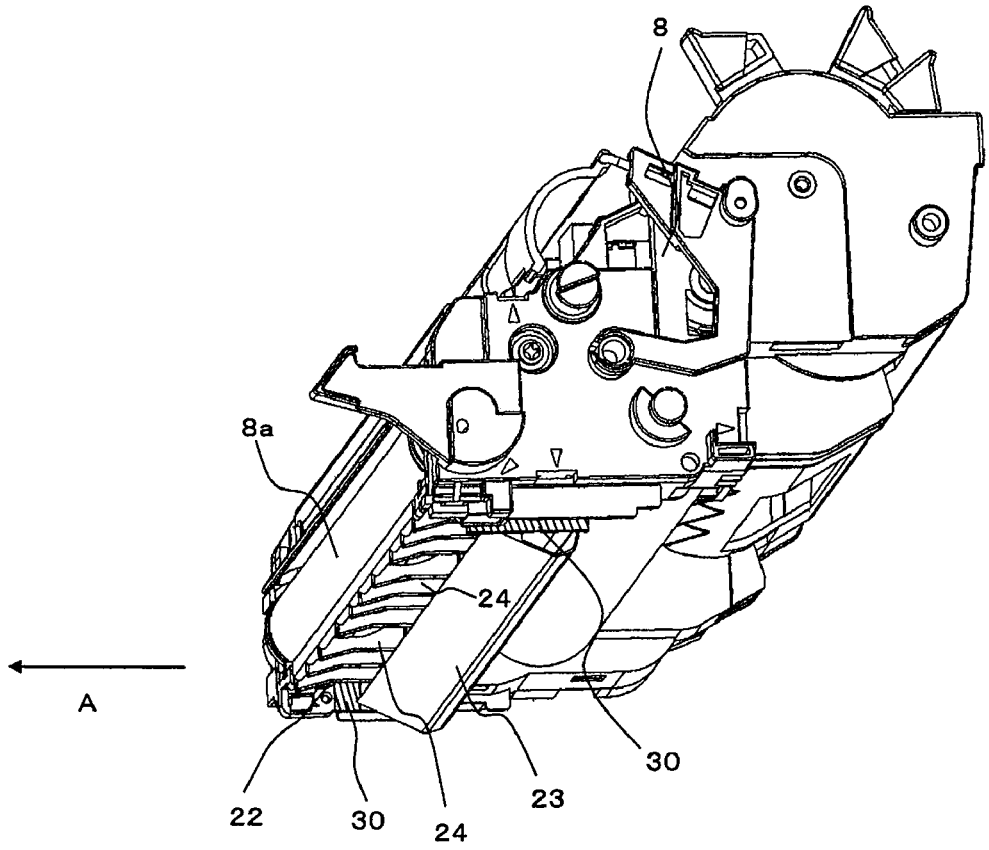
FIG. 3 is an external perspective view of a developing unit in the printer according to the embodiment of FIG. 2

FIG. 3 is a perspective view of the developing unit 8 according to this embodiment. As shown in FIG. 3, the upper guide 22 is defined, in part, by lower edges of guide plates 24 extending orthogonally at the lower surface of the developing unit 8. The trailing-end-springing prevention member 23 is provided on the lower surface of the developing unit 8 and extends entirely across widthwise the transfer conveying-path 20. In FIG. 3, the sheet feeding direction is denoted by arrow A.

Figure 4:
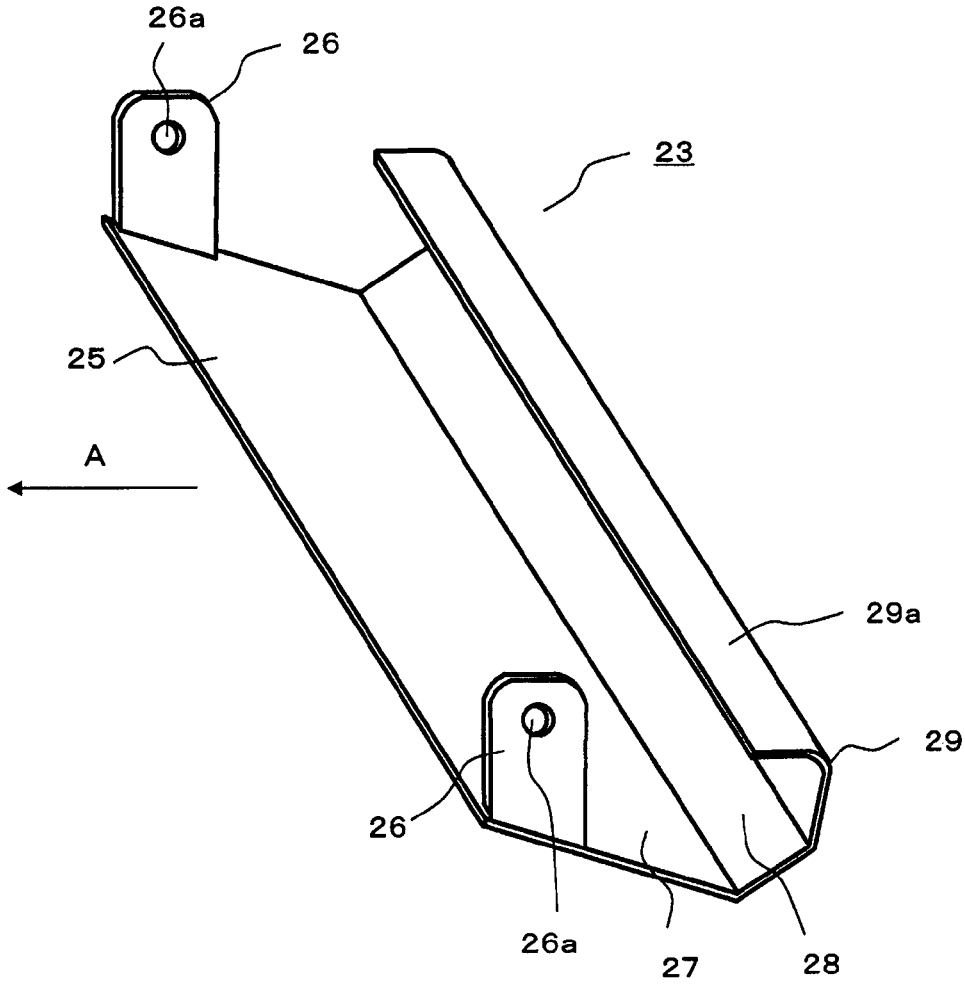
FIG. 4 is an external perspective view of a trailing-end-springing prevention member in the printer according to the embodiment of FIG. 2.

FIG. 4 is an external view of the trailing-end-springing prevention member (biasing member) 23. As shown in FIG. 4, the trailing-end-springing prevention member 23 is formed by bending a thin metal plate, and includes a guide portion 25 extending along the transfer conveying-path 20 and bearing portions 26 provided near the downstream side of the guide portion 25 in the feeding direction A and extending orthogonally to the guide portion 25 from opposite ends thereof widthwise of the transfer conveying-path 20. The bearing portions 26 each have a through-hole 26*a* into which a rotating shaft, described later, can be inserted. The guide portion 25 has a downstream slope segment 27 that is downwardly inclined from where the bearing portions 26 are provided towards the upstream side, an upstream slope segment 28 that is upwardly inclined from the upstream edge of the downstream slope segment 27 towards the upstream side, and a bent segment 29 that extends upwardly from the upstream edge of the upstream slope segment 28 and bends in a downstream direction. This portion of the bent segment 29, that extends in the downstream direction, functions as an abutment portion 29*a* that is brought into abutment with stopper members 32; described later.

Figure 5:
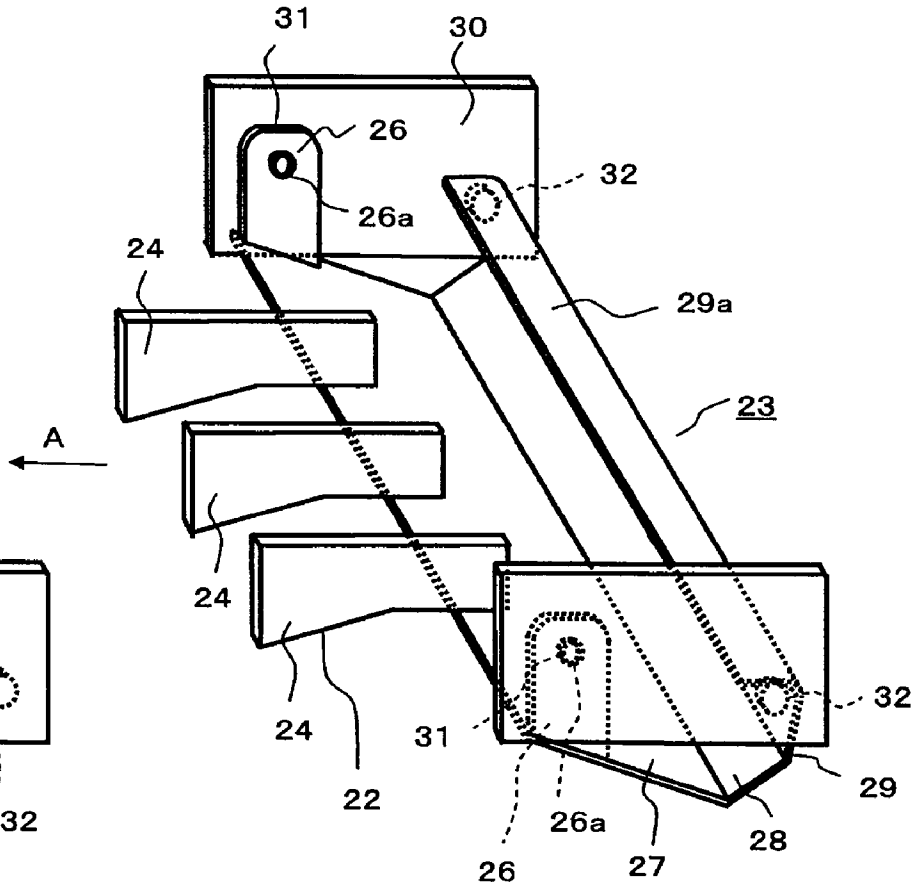
FIG. 5(*a*) is a perspective view illustrating some of the components that constitute the developing unit in the embodiment of FIG. 2.
Figure 5:
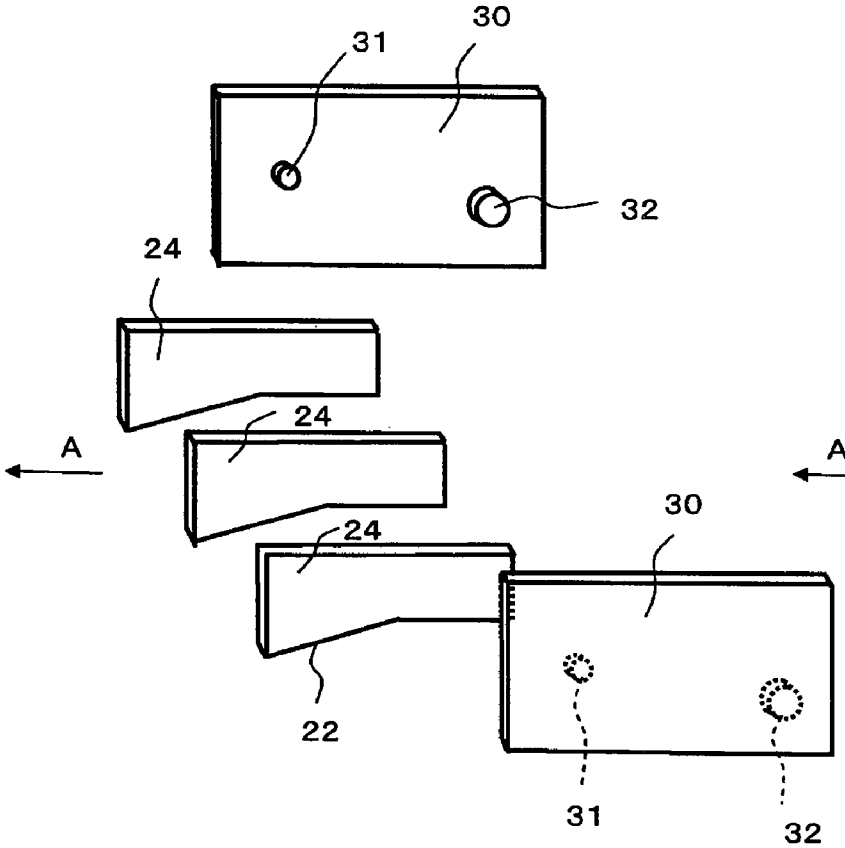

FIG. 5(*a*) schematically illustrates the lower surface of the developing unit 8 and the vicinity thereof, as viewed from a top perspective view, showing a state where the trailing-end-springing prevention member 23 is removed. Specifically, FIG. 5(*a*) shows the guide plates 24 and developing-unit frame components 30 constituting a frame of the developing unit 8 and provided adjacent to opposite sides of the multiple guide plates 24. In FIG. 3, these developing-unit frame components 30 are indicated with diagonal lines. In FIG. 5(*a*), only some of the guide plates 24 are shown.

As shown in FIG. 5(*a*), the inner side of each developing-unit frame component 30 is provided with a rotating shaft 31 and a cylindrical stopper member 32 for stopping the trailing-end-springing prevention member 23 from pivoting. The stopper members 32 are provided upstream relative to the rotating shafts 31. The pivoting-stopping feature of the stopper members 32 will be described later.

FIG. 5(*b*) schematically illustrates the state where the trailing-end-springing prevention member 23 is attached to the developing unit 8 shown in FIG. 5(*a*). Specifically, the rotating shafts 31 are inserted into the through-holes 26*a*, and the abutment portion 29*a* is placed on the stopper members 32 so as to be held by the stopper members 32, whereby the trailing-end-springing prevention member 23 is attached to the developing unit 8.

As shown in FIG. 2, when the trailing-end-springing prevention member 23 is attached to the developing unit 8, an angular portion (i.e., a biasing portion 33) that connects the upstream slope segment 28 and the downstream slope segment 27 is located at the lowermost position and comes into contact with a sheet P so as to bias it downward. This biasing portion 33 is located lower than a line (i.e., a two-dot chain line L) that connects the registration nip 18 and the uppermost portion 21*a*.

The operation of the printer 1 described above will now be described.

First, an image forming operation will be briefly described below with reference to FIG. 1.

When image data is sent to the printer 1 from a data terminal device, such as a personal computer, the surface of the photosensitive drum 5 is uniformly charged by the charging unit 6. The exposure unit 7 then irradiates the image onto the surface of the photosensitive drum 5 by exposure; this forms an electrostatic latent image. The electrostatic latent image is developed using toner supplied from the developing unit 8, thereby forming a toner image.

At the same time, a sheet P is fed from the sheet cassette 2 or 3 or from the manual feed tray 4 and is temporarily stopped at the registration nip 18. The sheet P is then fed from the registration nip 18 to the transfer nip 19 in accordance with the toner image formed on the photosensitive drum 5. The toner image is transferred onto the sheet P at the transfer nip 19. Subsequently, the transferred toner image is fixed to the sheet P by the fixing unit 11. Finally, the sheet P is ejected onto the output tray 12.

The following description relates to how a thick sheet 40 having high elasticity is fed from the registration nip 18 towards the transfer nip 19 so an image can be formed on the thick sheet 40.

Figure 6:
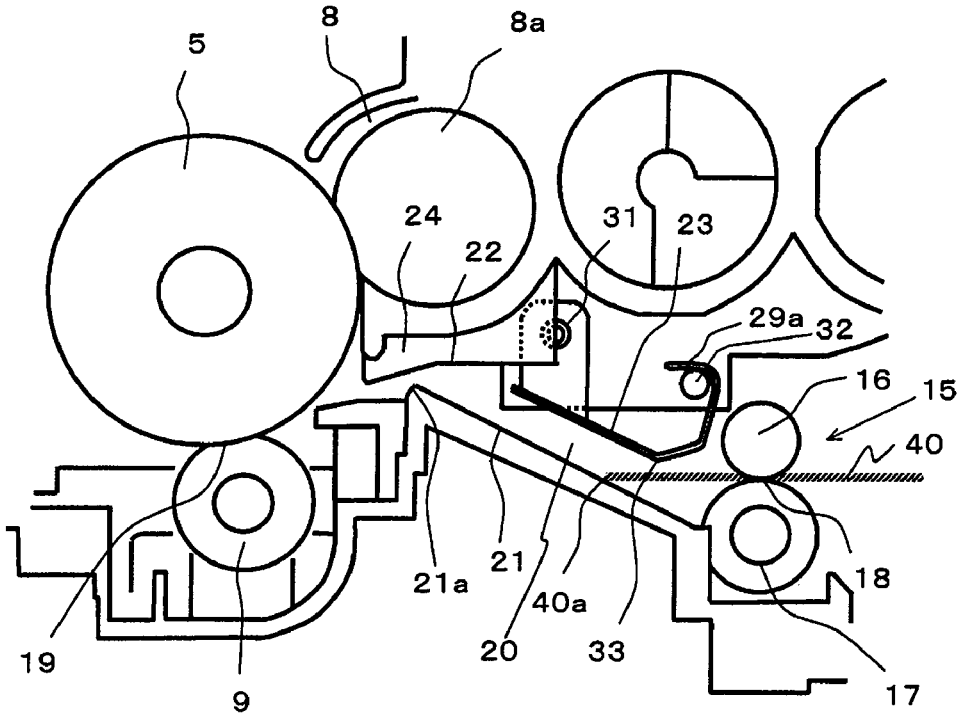
FIG. 6(*a*) is a partial cross-sectional view illustrating a thick sheet being fed through a transfer conveying-path in the printer according to the embodiment of FIG. 2.
Figure 6:
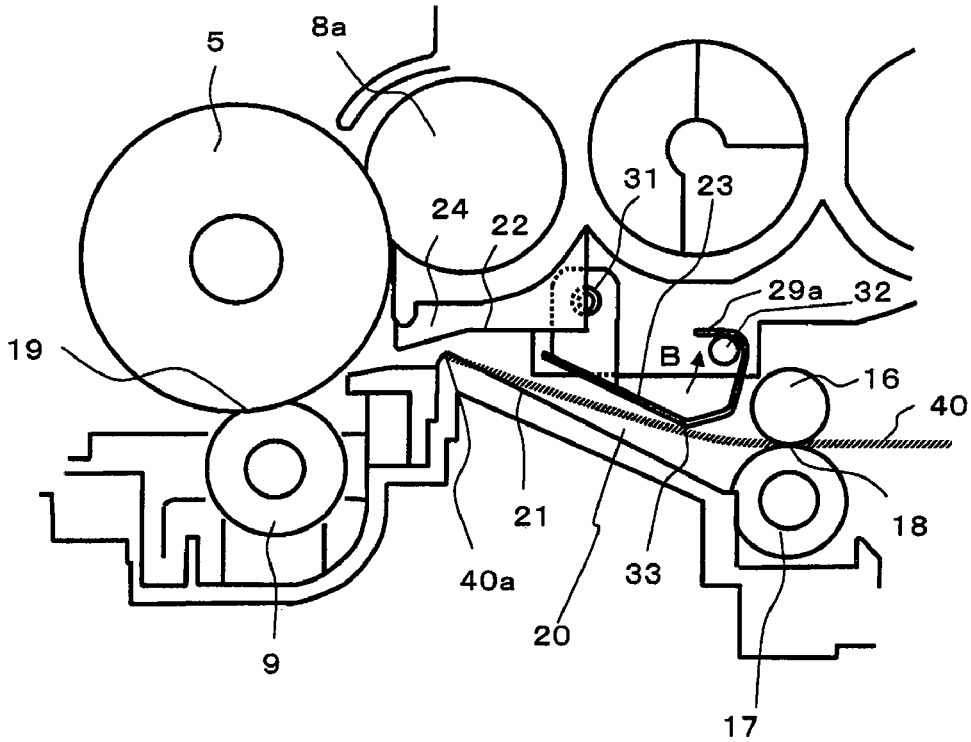
Figure 6:
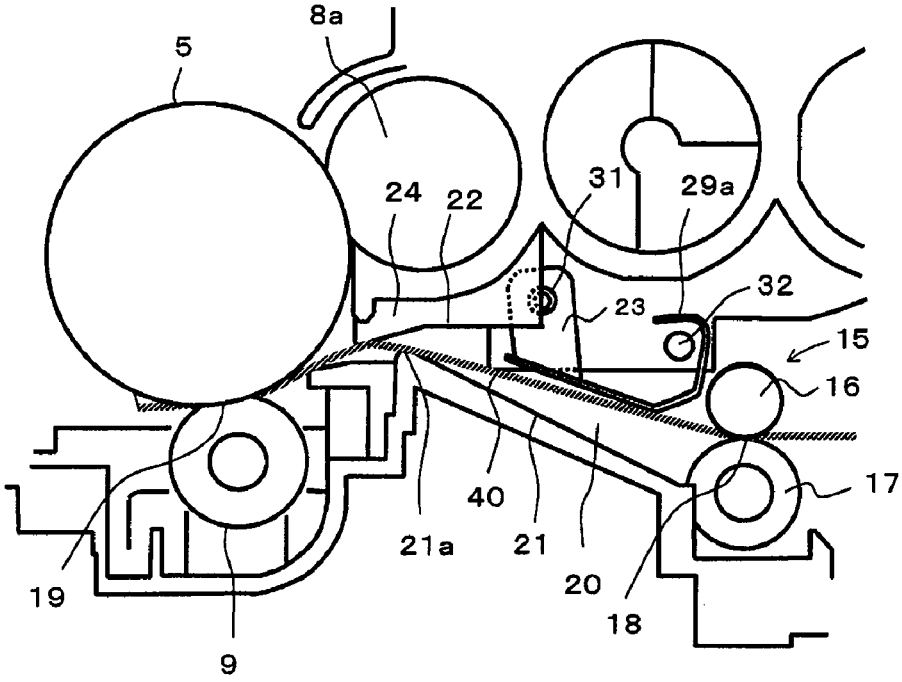
Figure 6:
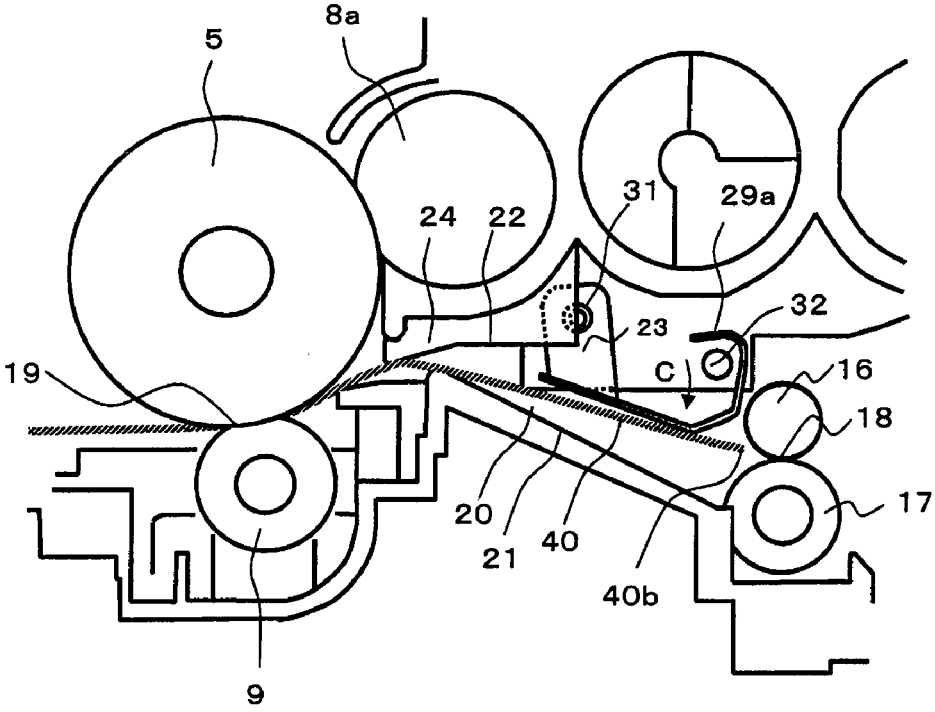
Figure 6:
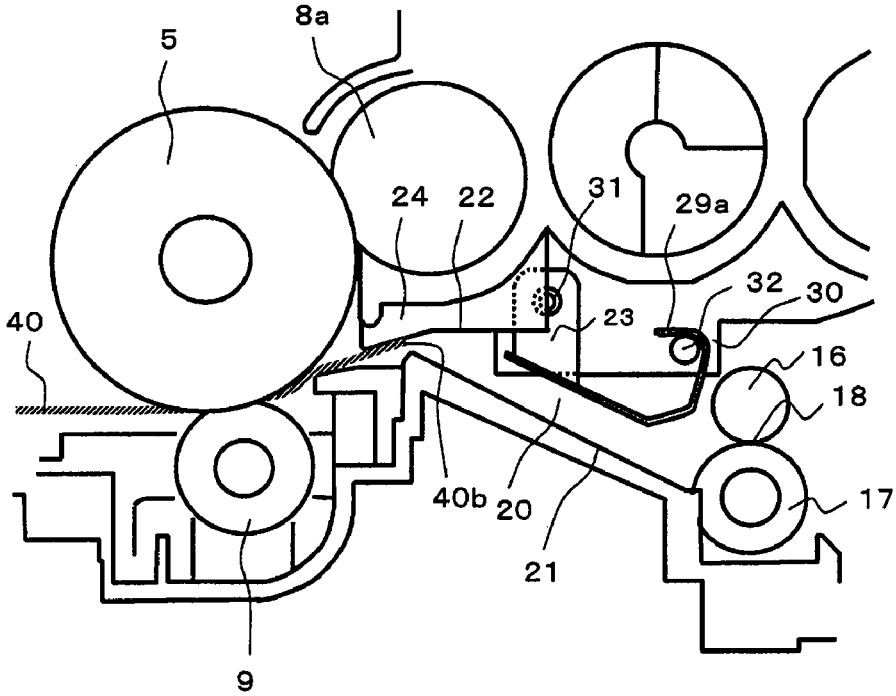

FIG. 6(*a*) is a cross-sectional view showing the state where the thick sheet 40 is fed by the pair of registration rollers 15. When the thick sheet 40 is fed through the registration nip 18, a leading end 40*a* of the thick sheet 40 comes into contact with the slope of the lower guide 21 located upstream of the uppermost portion 21*a* and moves upward along the lower guide 21. The thick sheet 40 then comes into contact with the biasing portion 33 of the trailing-end-springing prevention member 23 from below, as shown in FIG. 6(*b*).

As the thick sheet 40 moves further downstream, the leading end 40*a* enters the transfer nip 19. Since the thick sheet 40 has a high elasticity, the thick sheet 40 presses the trailing-end-springing prevention member 23 upward, causing the trailing-end-springing prevention member 23 to pivot upward about the rotating shafts 31 (i.e., in a direction indicated by arrow B), as shown in FIGS. 6(*b*) and 6(*c*).

As the thick sheet 40 is fed further downstream, a trailing end 40*b* thereof is released from the registration nip 18, as shown in FIG. 6(*d*). As the result of it being released from the registration nip 18, the trailing end 40*b* of the thick sheet 40 becomes free, and the trailing-end-springing prevention member 23 pivots in the direction indicated by arrow C due to its own weight. Thus, the trailing end 40*b* of the thick sheet 40 is biased downward thereby being prevented from springing upward.

As the thick sheet 40 is fed further downstream, the trailing end 40*b* moves past the trailing-end-springing prevention member 23, and the trailing-end-springing prevention member 23 pivots further downward (in the direction indicated by arrow C). This causes the abutment portion 29*a* to contact the stopper members 32, thereby stopping the trailing-end-springing prevention member 23 from pivoting, as shown in FIGS. 6(*d*) and 6(*e*).

Accordingly, when the thick sheet 40 is fed in this manner in the printer 1 according to the present embodiment, the elasticity of the thick sheet 40 causes the trailing-end-springing prevention member 23 to pivot upwardly. This reduces the frictional resistance produced between the thick sheet 40 and the trailing-end-springing prevention member 23, thereby minimizing the occurrence of image shrinkage. Furthermore, since the trailing-end-springing prevention member 23 reduces the amount by which the trailing end 40*b* of the thick sheet 40 springs upwardly, shock produced as a result of springing is alleviated, thereby minimizing the occurrence of transfer deviation.

Figure 7:
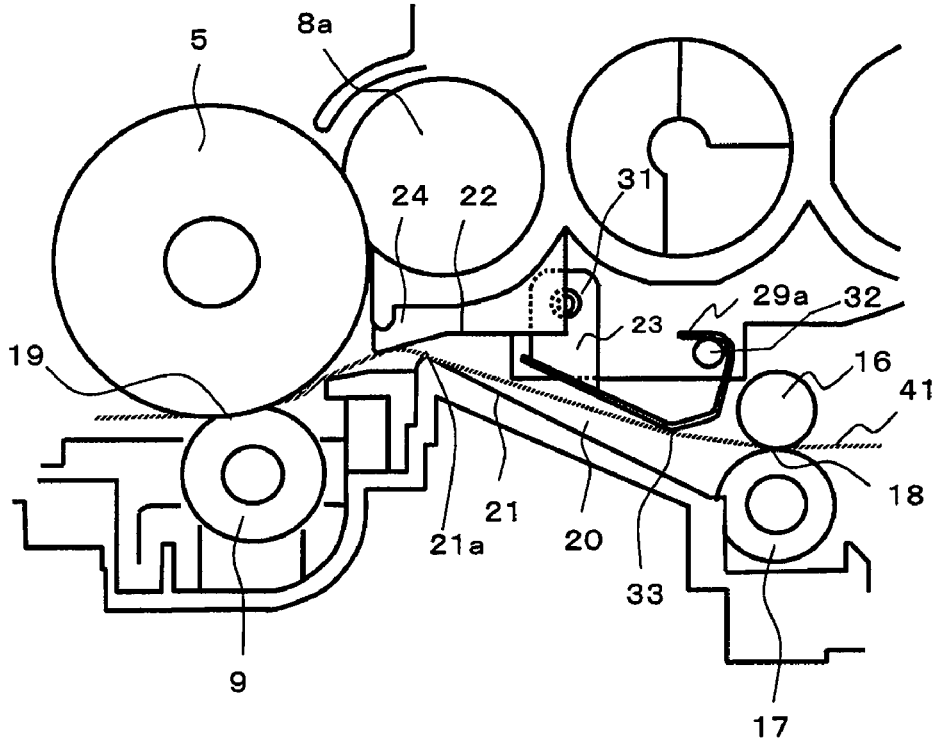
FIG. 7 is a partial cross-sectional view illustrating a sheet being fed through the transfer conveying-path in the printer according to the embodiment of FIG. 2.

FIG. 7 illustrates a situation where a normal sheet having a lower elasticity than a thick sheet is fed. Even when a normal sheet 41 is supported by the registration nip 18, the normal sheet 41 is incapable of lifting the trailing-end-springing prevention member 23 upward. However, since the normal sheet 41 has a reduced amount of force that can press back against the trailing-end-springing prevention member 23, the frictional force between the normal sheet 41 and the trailing-end-springing prevention member 23 is not great. Therefore, image shrinkage hardly occurs. In addition, since the normal sheet 41 is pressed downwardly by the trailing-end-springing prevention member 23, the normal sheet 41 does not spring upward when the trailing end thereof is released from the registration nip 18. This means that transfer deviation does not occur.

Accordingly, in the printer 1 according to the present embodiment, the occurrence of transfer deviation and image shrinkage can be minimized, regardless of the degree of elasticity of the sheet. In this embodiment, the occurrence of transfer deviation and image shrinkage can be minimized with respect to a sheet having a basis weight of up to about 220 g/m$^2$ as a thick sheet having high elasticity.

The advantages of the present invention can also be achieved when the stopper members 32 are not provided. In that case, because the trailing-end-springing prevention member 23 pivots further downwardly due to its own weight relative to the state shown in FIG. 6(*e*), the biasing portion 33 also moves further downwardly, and the trailing-end-springing prevention member 23 stops when it reaches a balanced position.

In this embodiment, it is preferable that the biasing portion 33 of the trailing-end-springing prevention member 23 be disposed lower than line L (indicated by a two-dot chain line in FIG. 2) that connects the uppermost portion 21*a* of the lower guide 21 and the registration nip 18. This alleviates the degree of springing of the trailing end 40*b* of the thick sheet 40, thereby further minimizing the occurrence of transfer deviation.

Although the biasing portion 33 is located between the rotating shafts 31 and the pair of registration rollers 15 in this embodiment, the biasing portion 33 may alternatively be located between the rotating shafts 31 and the uppermost portion 21*a* of the lower guide 21. In that situation, the arrangement of the trailing-end-springing prevention member 23 may be such that the upstream side and the downstream side thereof are inverted relative to the arrangement in this embodiment.

A printer according to another embodiment of the present invention will now be described. The printer according to this embodiment is basically the same as that in the previous embodiment, but mainly differs from that in the shape of the trailing-end-springing prevention member and in the absence of stopper members 32. Therefore, the description below will mainly be directed to those differences.

Figure 8:
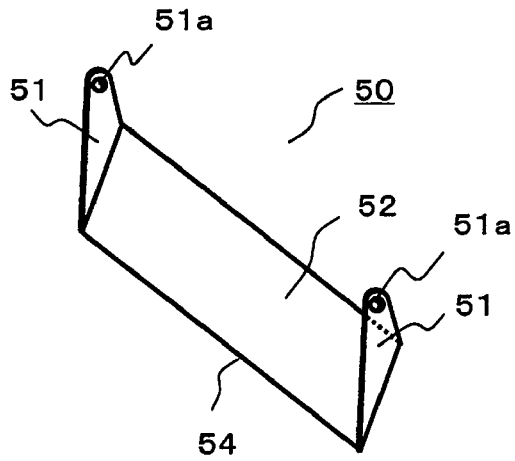
FIG. 8 is an external perspective view of a trailing-end-springing prevention member in a printer according to another embodiment of the present invention.
Figure 9:
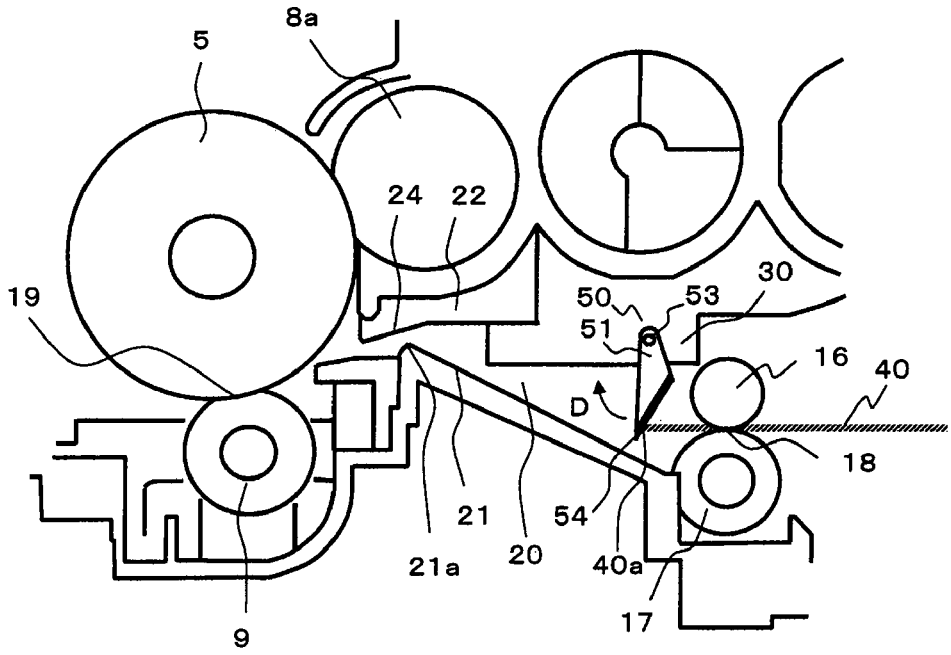
FIG. 9 is a partial cross-sectional view illustrating the transfer conveying-path and the vicinity thereof in the printer according to the embodiment of FIG. 8.

FIG. 8 is a perspective view of a trailing-end-springing prevention member 50 in the printer according to this embodiment. FIG. 9 schematically illustrates the transfer conveying-path 20 and the vicinity thereof in the printer according to the embodiment.

The trailing-end-springing prevention member 50 is formed of a thin metal plate, and includes a planar portion 52 extending across the transfer conveying-path 20 in a width direction thereof and bearing portions 51 extending orthogonally to the planar portion 52 from opposite ends thereof to corresponding rotating shafts 53. The planar portion 52 is disposed at an angle so that it is inclined upwardly toward the upstream side in the sheet feed direction when the trailing-end-springing prevention member 50 hangs down, due to its own weight. The bearing portions 51 are triangular, each having a through-hole 51*a* into which the corresponding rotating shaft 53 can be inserted. The developing-unit frame components 30 are different from those in the previous embodiment in that they are only provided with the rotating shafts 53. The trailing-end-springing prevention member 50 is attached to the developing unit 8 by inserting the rotating shafts 53 into the corresponding through-holes 51*a* formed in the bearing portions 51. In the state where the trailing-end-springing prevention member 50 is attached, the lower edge of the planar portion 52 acts as a biasing portion 54 that comes into contact with a fed sheet so as to bias the sheet downwardly. The biasing portion 54 is positioned lower than the registration nip 18. Since the stopper members 32 in the previous embodiment are not provided in this embodiment, the trailing-end-springing prevention member 50 is different from that embodiment in that it is not stopped at an intermediate position and pivots due to its weight until the biasing portion 54 descends to a lowermost point, as shown in FIG. 9. An example of a pivoting member according to the present invention corresponds to the trailing-end-springing prevention member 50 according to this embodiment.

Figure 10:
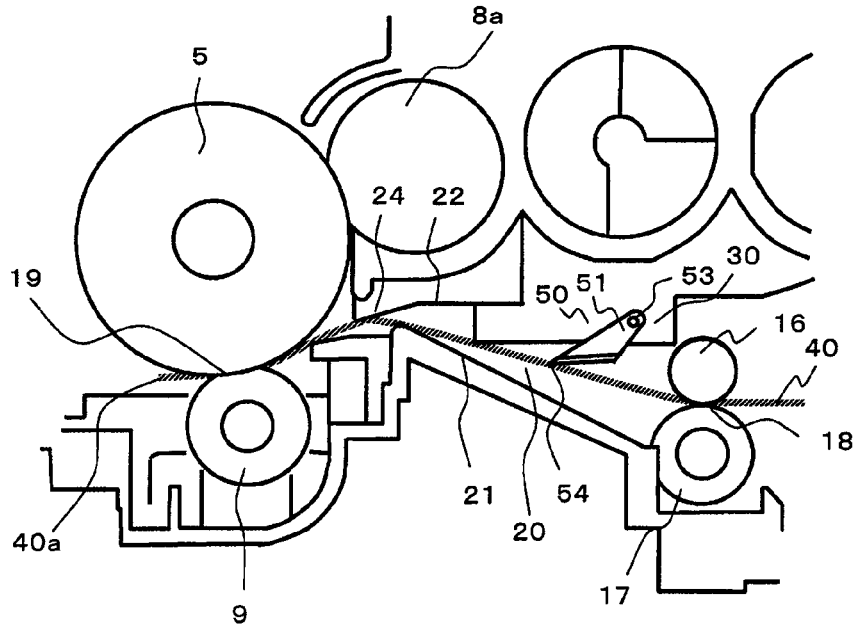
FIG. 10 is a partial cross-sectional view illustrating a thick sheet being fed through the transfer conveying-path in the printer according to the embodiment of FIG. 8.

In this configuration, when a thick sheet 40 is fed through the registration nip 18, the leading end 40*a* of the thick sheet 40 comes into contact with the planar portion 52, as shown in FIG. 9. As the thick sheet 40 is fed further downstream, the elasticity of the thick sheet 40 causes the trailing-end-springing prevention member 50 to pivot towards the downstream side (i.e., in the direction indicated by arrow D) about the rotating shafts 53, thereby tilting the trailing-end-springing prevention member 50 in the downstream direction while the biasing portion 54 is in contact with the upper surface of the thick sheet 40, as shown in FIG. 10.

Since the trailing-end-springing prevention member 50 tries to pivot downward (i.e., in an opposite direction to the direction of arrow D) due to its own weight, the thick sheet 40 is biased downwardly during the feeding operation. When the trailing end 40*b* exits the registration nip 18 as the thick sheet 40 is fed further downstream in such a state, the trailing end 40*b* is prevented from springing in an upward direction since the thick sheet 40 is biased downward, thereby minimizing the occurrence of transfer deviation. Furthermore, because the trailing-end-springing prevention member 50 pivots upward as the thick sheet 40 is fed downstream, the frictional force is reduced, the occurrence of image shrinkage can also be minimized.

As in the previous embodiment, when a normal sheet is fed, the trailing-end-springing prevention member 50 does not pivot upwardly because of its weight. Since a normal sheet has a reduced amount of force that presses back against the trailing-end-springing prevention member 50, the frictional force between the normal sheet and the trailing-end-springing prevention member 50 is small. Therefore, image shrinkage hardly occurs. In addition, the trailing-end-springing prevention member 50 reduces the amount by which the trailing end of the normal sheet springs upwardly, thereby minimizing the occurrence of transfer deviation.

Accordingly, in the printer according to this embodiment, the occurrence of transfer deviation and image shrinkage can be minimized, regardless of the elasticity of the sheet.

The weight of the trailing-end-springing prevention members 23 and 50 according to the present and previous embodiments may be such that they pivot, or move, by a small amount when a normal sheet is used. However, these trailing-end-springing prevention members 23 and 50 need to have enough weight to prevent the trailing end 40*b* from springing upwardly when a thick sheet 40 is fed.

In this embodiment, it is preferable that the biasing portion 54 of the trailing-end-springing prevention member 50 is located below line L (not shown) that connects the uppermost portion 21*a* of the lower guide 21 and the registration nip 18. This alleviates the degree of springing of the trailing end 40*b* of the thick sheet 40, thereby further minimizing the occurrence of transfer deviation.

A printer according to another embodiment of the present invention will now be described. The printer according to this embodiment is basically the same as that in the first described embodiment, but differs from that in the structure for preventing the trailing end 40*b* of the thick sheet 40 from springing upwardly. Therefore, the description below will mainly focus on those differences.

Figure 11:
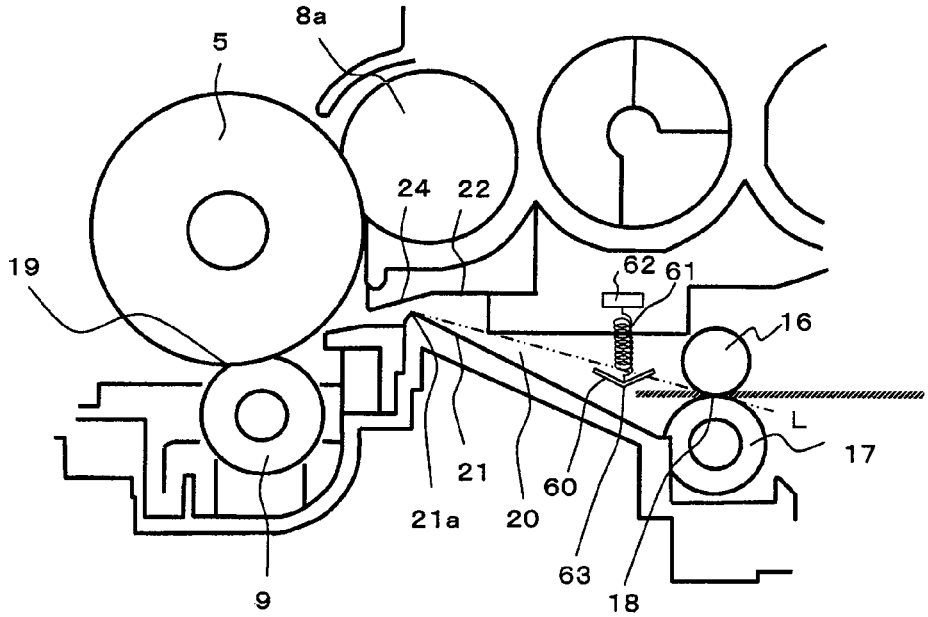
FIG. 11 is a partial cross-sectional view illustrating the transfer conveying-path and the vicinity thereof in a printer according to a further embodiment of the present invention.
Figure 12:
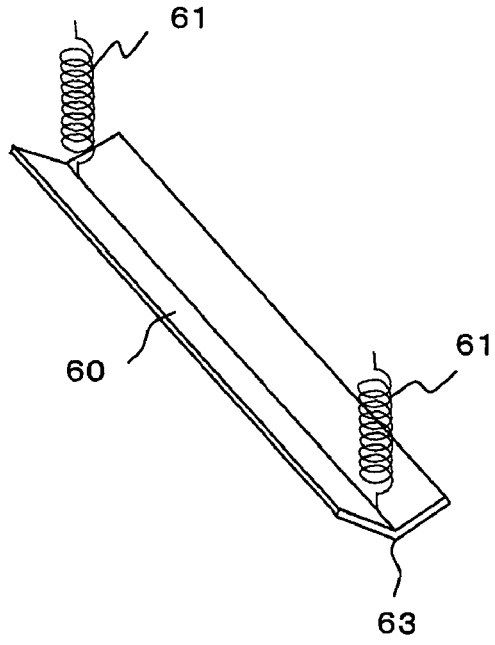
FIG. 12 is an external perspective view illustrating a trailing-end-springing prevention member and spring members of the embodiment of FIG. 11.

FIG. 11 schematically illustrates the transfer conveying-path 20 and the vicinity thereof in the printer according to this embodiment. In this printer, a metallic trailing-end-springing prevention member (elastic member) 60 having a V-shape when viewed from the side is provided in the transfer conveying-path 20. The trailing-end-springing prevention member 60 is supported by spring members 61. FIG. 12 is a perspective view showing a state where the spring members 61 are attached to the trailing-end-springing prevention member 60 according to this embodiment. Lower ends of the spring members 61 are respectively fixed to the upper surface of two longitudinal ends of the trailing-end-springing prevention member 60. As shown in FIG. 11, upper ends of the two spring members 61 are fixed to projections 62 formed on the developing-unit frame components 30.

The lower edge of the V-shaped trailing-end-springing prevention member 60 serves as a biasing portion 63 that comes into contact with a sheet so as to bias the sheet downwardly. This biasing portion 63 is located below line L (indicated by a two-dot chain line in FIG. 11) that connects the registration nip 18 and the uppermost portion 21*a* of the lower guide 21.

Figure 13:
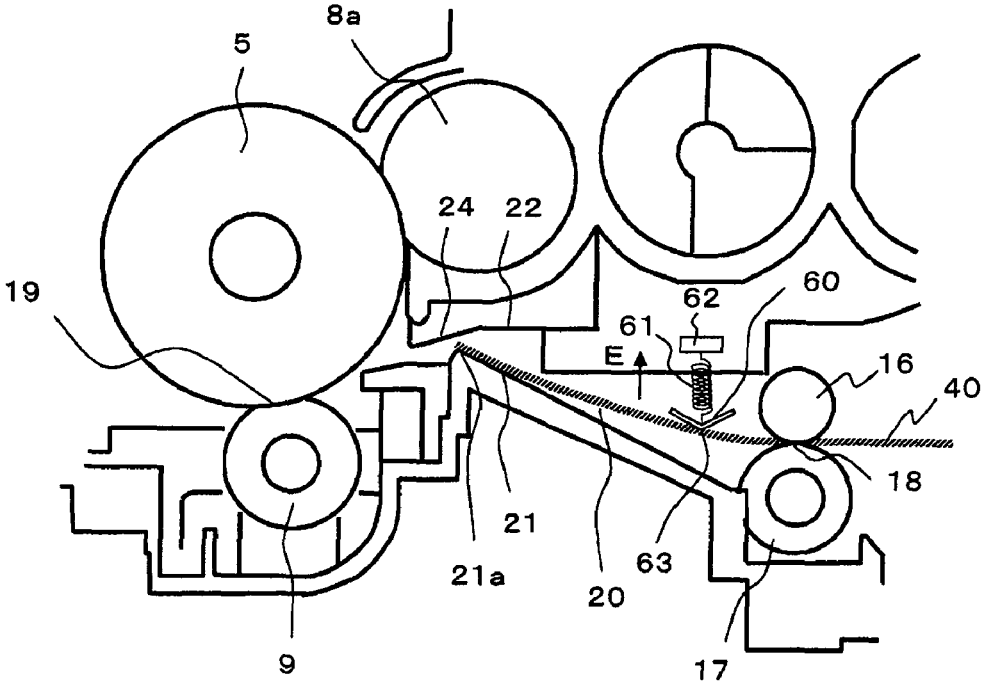
FIG. 13(*a*) is a partial cross-sectional view illustrating a thick sheet being fed through the transfer conveying-path in the printer according to the embodiment of FIG. 11.
Figure 13:
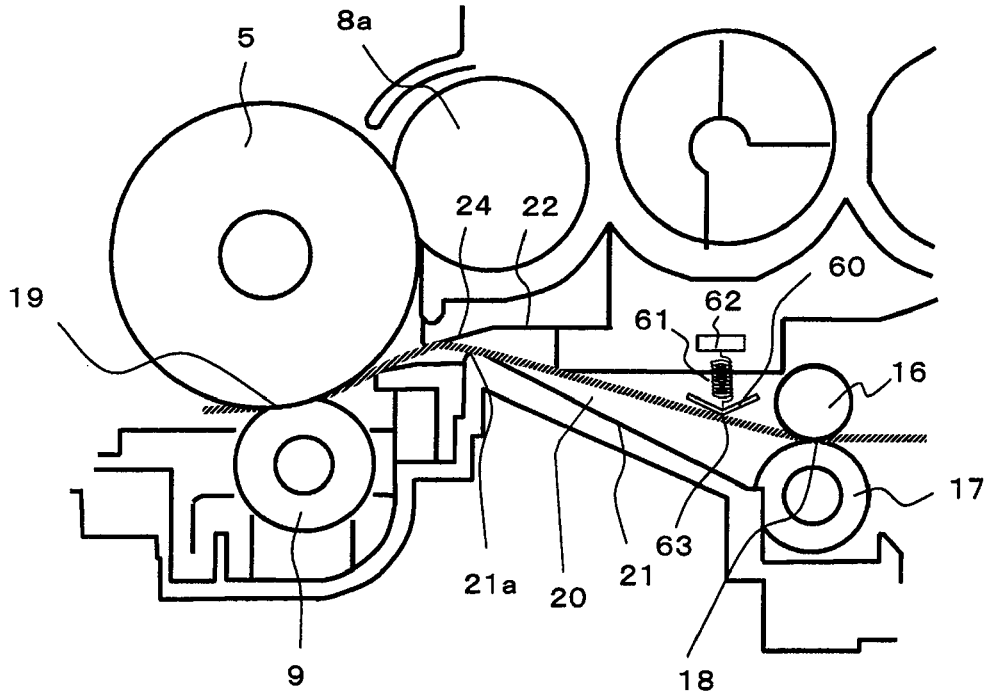
Figure 13:
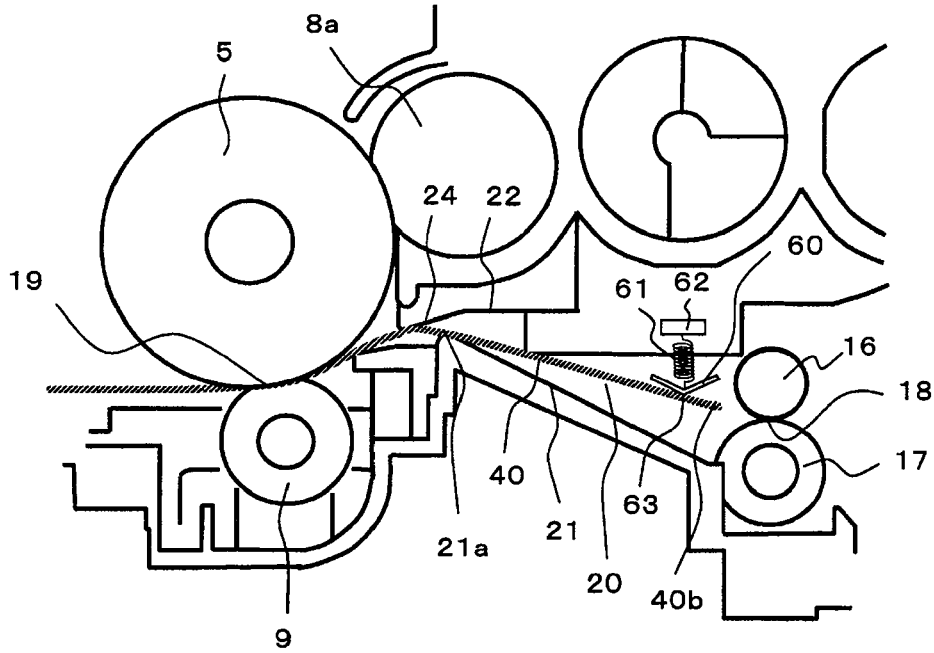
Figure 14:
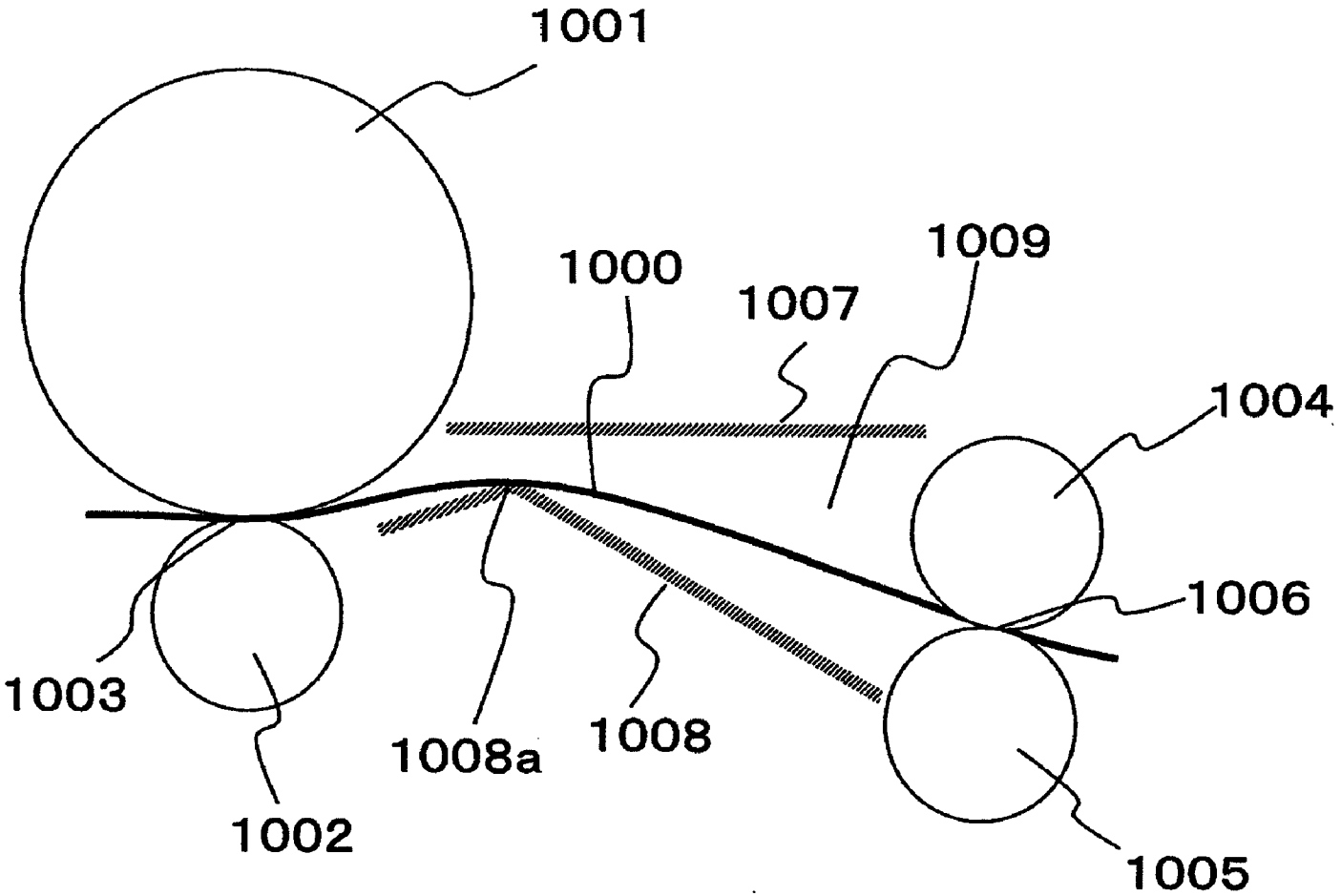
Fig. 14 Prior Art
FIG. 14 illustrates the configuration of an image forming device of the prior art.
Figure 15:
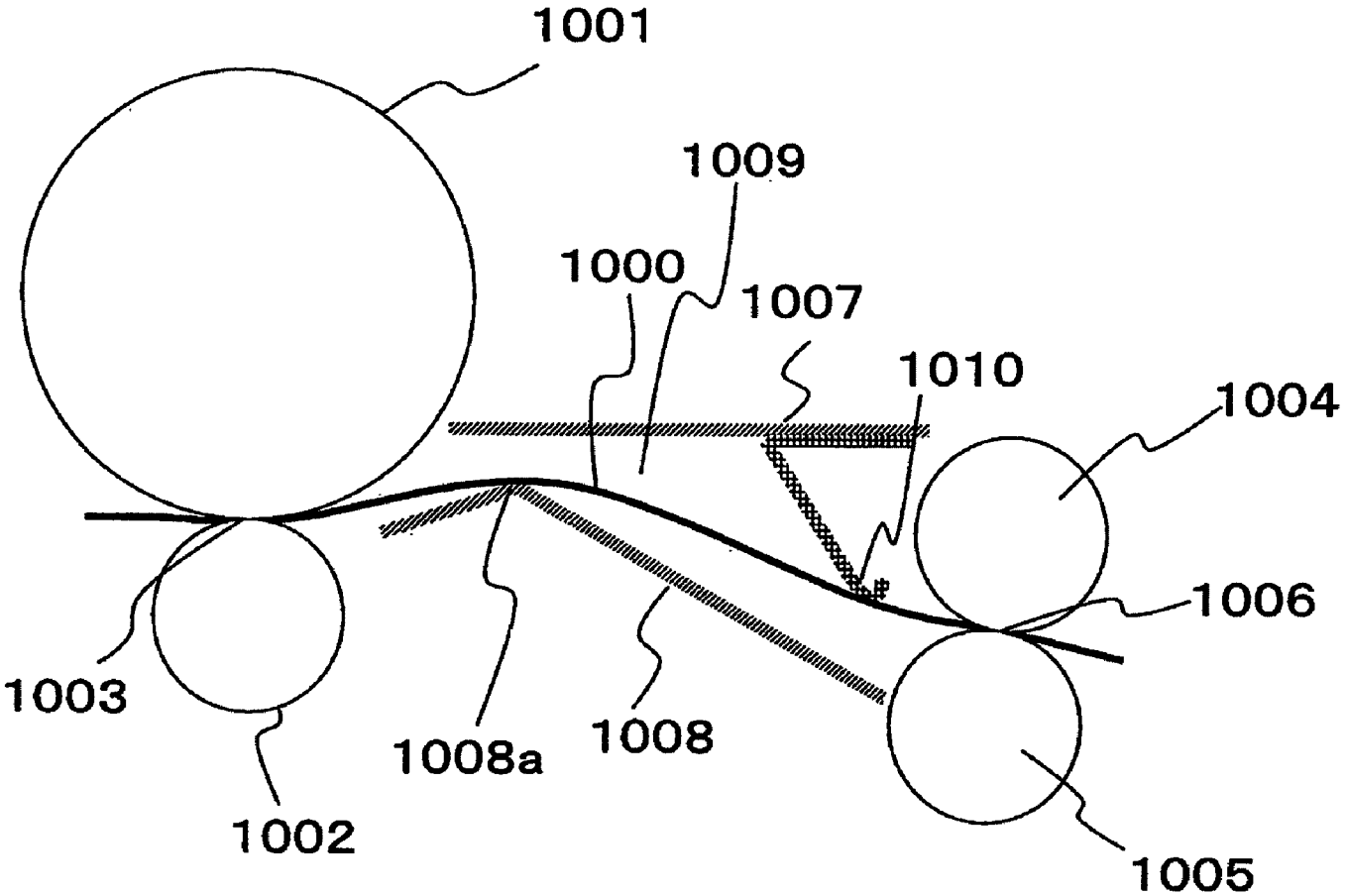
Fig. 15 Prior Art
FIG. 15 illustrates the configuration of an image forming device of the prior art.

The following description relates to how the thick sheet 40 is fed through the transfer conveying-path 20 in the printer according to this embodiment with reference to FIG. 11 and FIGS. 13(*a*) to 13(*c*), which are side views of the transfer conveying-path 20 and the vicinity thereof.

When the thick sheet 40 is fed through the pair of registration rollers 15, the leading end 40*a* of the thick sheet 40 comes into contact with the slope of the lower guide 21 located upstream of the uppermost portion 21*a* and then moves upwardly along the slope of the lower guide 21.

As the result of this movement, the upper surface of the thick sheet 40 comes into contact with the biasing portion 63 of the trailing-end-springing prevention member 60 from below, as shown in FIG. 13(*a*). As the thick sheet 40 moves further downstream, the leading end 40*a* enters the transfer nip 19, as shown in FIG. 13(*b*). In this case, since the thick sheet 40 has a high elasticity, the thick sheet 40 presses the trailing-end-springing prevention member 60 upwardly, causing the trailing-end-springing prevention member 60 to move upwardly (i.e., in a direction indicated by arrow E in FIG. 13(*a*)).

While the thick sheet 40 is fed, the thick sheet 40 is biased downwardly due to the elastic force of the spring members 61 and the weight of the trailing-end-springing prevention member 60, as shown in FIG. 13(*b*). Subsequently, the trailing end 40*b* exits the registration nip 18. Since the trailing end 40*b* is biased downwardly due to the weight of the trailing-end-springing prevention member 60, the trailing end 40*b* is prevented from springing upwardly, as shown in FIG. 13(*c*).

As the thick sheet 40 is fed further downstream, the trailing end 40*b* moves past the trailing-end-springing prevention member 60. As a result, due to the weight of trailing-end-springing prevention member 60 it moves downwardly, thereby returning to the position shown in FIG. 11.

Accordingly, when the thick sheet 40 is fed in this manner in the printer according to this embodiment, the elasticity of the thick sheet 40 causes the trailing-end-springing prevention member 60 to move upwardly. This reduces the frictional resistance, thereby minimizing the occurrence of image shrinkage. Furthermore, since the trailing-end-springing prevention member 60 reduces the amount by which the trailing end 40*b* of the thick sheet 40 springs upwardly, the occurrence of transfer deviation is also minimized.

When a normal sheet is fed, since the sheet has a lower elasticity, due to its weight, the trailing-end-springing prevention member 60 does not move upwardly. Because a normal sheet has a reduced amount of force that can press back against the trailing-end-springing prevention member 60, the frictional force between the normal sheet and the trailing-end-springing prevention member 60 is small. Therefore, the feed rate is not slowed down, thereby preventing the occurrence of image shrinkage. Since the trailing-end-springing prevention member 60 reduces the amount by which the trailing end of the normal sheet springs upwardly, the occurrence of transfer deviation is minimized.

Accordingly, in the printer according to this embodiment, the occurrence of transfer deviation and image shrinkage can be minimized, regardless of the elasticity of a sheet.

In this embodiment, it is preferable that the biasing portion 63 of the trailing-end-springing prevention member 60 is located below line L that connects the uppermost portion 21*a* of the lower guide 21 and the registration nip 18. This alleviates the degree of springing of the trailing end 40*b* of the thick sheet 40, thereby further minimizing the occurrence of transfer deviation.

The weight of the trailing-end-springing prevention member 60 according to this embodiment may be such that it pivots, or moves by a small amount, when a normal sheet is used. However, the trailing-end-springing prevention member 60 needs to have enough weight to prevent the trailing end 40*b* from springing upwardly when a thick sheet 40 is fed.

The trailing-end-springing prevention members 23, 50, and 60 according to the present invention are all preferably made of a conductive material, such as metal. By electrically connecting the trailing-end-springing prevention member to a frame of the printer, a sheet that is electrically charged at the pair of registration rollers 15 can be neutralized. This is further advantageous in view of image-shrinkage prevention since the frictional force between the sheet and the trailing-end-springing prevention member is prevented from increasing as a result of the sheet becoming attached to the trailing-end-springing prevention member by electrostatic attraction.

In the discussed embodiments, the trailing-end-springing prevention members 23, 50, and 60 are configured to be pivotable or movable upwardly when the developing unit 8 is detached from the printer and placed on, for example, the ground or a base. This can avoid deformation of the trailing-end-springing prevention members 23, 50, and 60.

The trailing-end-springing prevention members 23, 50, and 60 according to the present invention may be provided in a midsection, for example, of the transfer conveying-path 20 in the width direction thereof.

Furthermore, instead of being attached to the developing unit 8, the trailing-end-springing prevention members 23, 50, and 60 in the present invention may alternatively be attached to the device body of the printer.

Although a monochrome printer is described as an example of an image forming device in each of the above embodiments, the image forming device may alternatively be a color printer, a copier, a facsimile device, or a multifunction device.

The embodiments described above include the following aspects of the present invention.

A first aspect of the present invention is that it provides an image forming device for forming a developer image on a recording medium. The image forming device includes: a transfer roller; a pair of registration rollers that feed the recording medium to a transfer nip where the transfer roller is in contact with an image bearing member; a transfer conveying-path through which the recording medium is fed substantially horizontally from a registration nip formed by the pair of registration rollers to the transfer nip; a lower guide defining a lower side of the transfer conveying-path and having an uppermost portion that protrudes upwardly at a position upstream of the transfer nip; and a biasing member provided at an upper side of the transfer conveying-path and between the uppermost portion and the pair of registration rollers, and configured to bias the recording medium downwardly when the recording medium is fed through the pair of registration rollers. The biasing member is movable upwardly relative to the transfer conveying-path in response to a pressing force applied by the recording medium fed through the transfer conveying-path.

The biasing member may be a pivoting member that is pivotably supported by a rotating shaft that is parallel to a registration-roller axis.

Specifically, the biasing member may include: a guide portion provided along the transfer conveying-path, bearing portions that extend orthogonally to the guide portion from opposite ends thereof, in a width direction of the transfer conveying-path, to the rotating shaft, and an abutment portion that is brought into abutment with a stopper member that inhibits downward movement of the guide portion at a predetermined position. Moreover, the biasing member may be configured so as to come into contact with the recording medium at the guide portion and move upwardly in response to the elasticity of the recording medium.

Alternatively, the biasing member may include a planar portion extending across the transfer conveying-path and bearing portions that extend orthogonally to the planar portion from opposite ends thereof, in a width direction of the transfer conveying-path, to the rotating shaft. Moreover, the biasing member may be configured to be pivotable about the rotating shaft and hang down due to its weight.

The image forming device may further include an elastic member having one end fixed to a predetermined position at the upper side of the transfer conveying-path and another end fixed to the biasing member. In this situation, the biasing member may be configured to hang vertically down due to its weight when the recording medium is not passing by the biasing member and is configured to come into contact with the recording medium when the recording medium is passing by the biasing member so as to bias the recording medium downwardly in response to the elasticity of the recording medium using the elastic force of the elastic member.

The image forming section may include a developing unit and the biasing member may be supported by the developing unit.

A second aspect of the present invention is that it provides a method of forming an image. The method of forming an image comprising the steps of: feeding a recording medium using a pair of registration rollers to a transfer nip where a transfer roller is in contact with an image bearing member using a transfer conveying-path from a registration nip formed by the pair of registration rollers to the transfer nip; providing the recording medium to a lower guide at a lower side of the transfer conveying-path that comprises an uppermost portion that protrudes upwardly at a position upstream of the transfer nip; and biasing the recording medium downwardly when the recording medium is fed through the pair of registration rollers using a biasing member that is at an upper side of the transfer conveying-path and between the uppermost portion and the pair of registration rollers and is movable upwardly relative to the transfer conveying-path in response to a pressing force applied by the recording medium fed through the transfer conveying-path.

According to the present invention described above, an image forming device that can minimize the occurrence of transfer deviation and image shrinkage can be provided.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An image forming device having an image forming section and a transfer conveying-section, comprising:

a transfer roller;

a pair of registration rollers that feed a recording medium to a transfer nip where the transfer roller is in contact with an image bearing member;

a transfer conveying-path through which the recording medium is fed from a registration nip formed by the pair of registration rollers to the transfer nip;

a lower guide defining a lower side of the transfer conveying-path and having an uppermost portion that protrudes upwardly at a position upstream of the transfer nip; and a biasing member at an upper side of the transfer conveying-path and between the uppermost portion and the pair of registration rollers and configured to bias the recording medium downwardly when the recording medium is fed through the pair of registration rollers, the biasing member is movable upwardly relative to the transfer conveying-path in response to a pressing force applied by the recording medium fed through the transfer conveying-path, the biasing member comprises a pivoting member that is pivotably supported by a rotating shaft provided in parallel to a registration-roller axis.

2. The image forming device according to claim 1, wherein the biasing member includes a guide portion provided along the transfer conveying-path, bearing portions that extend orthogonally to the guide portion from opposite ends thereof, in a width direction of the transfer conveying-path, to the rotating shaft, and an abutment portion that is brought into abutment with a stopper member that inhibits downward movement of the guide portion at a predetermined position, and the biasing member comes into contact with the recording medium at the guide portion and moves upwardly in response to an elasticity of the recording medium using an elastic force of an elastic member.

3. The image forming device according to claim 2, wherein the biasing member is located between the rotating shaft located at the upper side of the transfer conveying-path and the pair of registration rollers, and the stopper member is located between the rotating shaft and the pair of registration rollers and is brought into abutment with the abutment portion extending from an upstream side of the guide portion.

4. The image forming device according to claim 2, wherein the biasing member is held by the stopper member when the recording medium is not passing by the biasing member.

5. The image forming device according to claim 2, wherein the biasing member is formed by bending a thin metal plate.

6. The image forming device according to claim 1, wherein the biasing member includes a planar portion extending across the transfer conveying-path and bearing portions that extend orthogonally to the planar portion from opposite ends thereof, in a width direction of the transfer conveying-path, to the rotating shaft, and the biasing member is pivotable about the rotating shaft and hangs down due to the weight of the biasing member.

7. The image forming device according to claim 6, wherein the biasing member is configured such that, when the recording medium is passing by the biasing member, the planar portion comes into contact with the recording medium causing the biasing member to tilt downstream in response to an elasticity of the recording medium.

8. The image forming device according to claim 6, wherein the biasing member is formed by bending a thin metal plate.

9. The image forming device according to claim 1, wherein a lowermost portion of the biasing member is positioned lower than a line that connects the uppermost portion of the lower guide and the registration nip, when the recording medium is not passing by the biasing member.

10. The image forming device according to claim 1, wherein the biasing member is made of a conductive material.

11. The image forming device according to claim 1, wherein the uppermost portion is located higher than the registration nip and the transfer nip.

12. The image forming device according to claim 1, wherein the image forming section includes a developing unit, and the biasing member is supported by the developing unit.

13. A method of forming an image comprising the steps of:

feeding a recording medium using a pair of registration rollers to a transfer nip where a transfer roller is in contact with an image bearing member using a transfer conveying-path from a registration nip formed by the pair of registration rollers to the transfer nip;

providing the recording medium to a lower guide at a lower side of the transfer conveying-path that comprises an uppermost portion that protrudes upwardly at a position upstream of the transfer nip; and biasing the recording medium downwardly when the recording medium is fed through the pair of registration rollers using a biasing member that is at an upper side of the transfer conveying-path and between the uppermost portion and the pair of registration rollers and is movable upwardly relative to the transfer conveying-path in response to a pressing force applied by the recording medium fed through the transfer conveying-path, the biasing member comprises a pivoting member that is pivotably supported by a rotating shaft provided in parallel to a registration-roller axis.

* * * * *